US006734616B2

(12) United States Patent
Lankhorst et al.

(10) Patent No.: US 6,734,616 B2
(45) Date of Patent: May 11, 2004

(54) LOW-PRESSURE MERCURY-VAPOR DISCHARGE LAMP AND AMALGAM

(75) Inventors: Martijn Henri Richard Lankhorst, Eindhoven (NL); Wilhelmus Cornelis Keur, Eindhoven (NL); Lambert Christiaan Ida Kaldenhoven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 131 days.

(21) Appl. No.: 09/811,635

(22) Filed: Mar. 19, 2001

(65) Prior Publication Data

US 2001/0030506 A1 Oct. 18, 2001

(30) Foreign Application Priority Data

Mar. 21, 2000 (EP) ..... 00201027

(51) Int. Cl.[7] ..... H01J 1/62; H01J 17/26

(52) U.S. Cl. ..... 313/490; 313/565; 313/547; 313/562; 313/577

(58) Field of Search ..... 313/490, 318.01–318.12, 313/561, 565, 577

(56) References Cited

U.S. PATENT DOCUMENTS

| | | | | |
|---|---|---|---|---|
| 4,093,889 A | | 6/1978 | Bloem et al. | 313/229 |
| 4,157,485 A | | 6/1979 | Wesselink et al. | 313/174 |
| 4,972,118 A | * | 11/1990 | Yorifuji et al. | 313/490 |
| 5,204,584 A | * | 4/1993 | Ikeda et al. | 313/490 |
| 5,907,216 A | * | 5/1999 | Ligthart et al. | 313/490 |
| 5,952,780 A | * | 9/1999 | Forsdyke et al. | 313/490 |
| 6,404,122 B1 | * | 6/2002 | Lankhorst et al. | 313/490 |

FOREIGN PATENT DOCUMENTS

| | | | | |
|---|---|---|---|---|
| EP | 0327346 A2 | | 8/1989 | H01J/61/28 |
| GB | 1176955 A | * | 1/1970 | H01J/61/28 |
| JP | 11016536 | | 1/1999 | H01J/61/28 |

* cited by examiner

*Primary Examiner*—Ashok Patel
*Assistant Examiner*—German Colón

(57) ABSTRACT

A low-pressure mercury-vapor discharge lamp is provided with a discharge vessel (10). The discharge vessel (10) encloses a discharge space (11) provided with a filling of mercury and an inert gas in a gastight manner. The discharge vessel (10) is provided with an amalgam which communicates with the discharge space (11). The discharge lamp comprises means for maintaining an electric discharge in the discharge vessel (10). The discharge lamp is characterized in that the amalgam comprises a bismuth-lead amalgam having a lead content in the range from $35 \leqq Pb \leqq 60$ at. %, a bismuth content in the range from $40 \leqq Bi \leqq 65$ at. %, and a mercury content in the range from $0.05 \leqq Hg \leqq 1$ at. %. Preferably, the amalgam additionally comprises gold with a gold content in the range from $0.1 \leqq Au \leqq 20$ at. %. Preferably, the gold content is in the range from $8 \leqq Au \leqq 12$ at. %. The lamp according to the invention exhibits a comparatively high initial radiation output and a short run-up time in combination with a relatively high radiation output at nominal lamp operation, which is achieved in a comparatively large temperature interval.

8 Claims, 3 Drawing Sheets

LOW-PRESSURE MERCURY-VAPOR DISCHARGE LAMP AND AMALGAM

BACKGROUND OF THE INVENTION

1. Field of the Invention

The invention relates to a low-pressure mercury-vapor discharge lamp comprising a discharge vessel, which discharge vessel encloses a discharge space provided with a filling of mercury and an inert gas in a gastight manner, which discharge vessel contains an amalgam which communicates with the discharge space, and the low-pressure mercury-vapor discharge lamp comprises discharge means for maintaining an electric discharge in the discharge space.

The invention also relates to an amalgam for use in the low-pressure mercury-vapor discharge lamp.

2. Discussion of the Prior Art

In mercury-vapor discharge lamps, mercury is the primary component for (efficiently) generating ultraviolet (UV) light. An inner wall of the discharge vessel may be coated with a luminescent layer comprising a luminescent material (for example a fluorescent powder) for converting UV to other wavelengths, such as UV-B and UV-A for tanning purposes (sunbed lamps) or to visible radiation for general lighting purposes. Such discharge lamps are therefore also referred to as fluorescent lamps. The discharge vessel of low-pressure mercury-vapor discharge lamps is generally tubular and circular in section, and comprises both elongated and compact embodiments. In general, the tubular discharge vessel of so-called compact fluorescent lamps comprises a collection of comparatively short, straight parts having a comparatively small diameter, which straight parts are interconnected, on the one hand, by means of bridge parts or, on the other hand, by means of, for example, arc-shaped parts. Compact fluorescent lamps are generally provided with a lamp cap (with integrated electronics).

In the description and the claims of the current invention, the designation "nominal operation" is used to refer to operating conditions where the mercury-vapor pressure is such that the radiation output of the lamp is at least 80% of that during optimum operation, i.e. under operating conditions where the mercury-vapor pressure is optimal. The amalgam limits the mercury-vapor pressure in the discharge vessel with respect to a discharge lamp containing only free mercury. This enables nominal operation of the lamp at comparatively high lamp temperatures, which may occur, for example, when the lamp is subjected to a high load or when the lamp is used in a closed or badly ventilated luminaire. Furthermore, in the description and the claims, the "initial radiation output" is defined as the radiation output of the discharge lamp 1 second after switching on the discharge lamp, and the "run-up time" is defined as the time needed by the discharge lamp to reach a radiation output of 80% of that during optimum operation.

A low-pressure mercury-vapor discharge lamp of the type mentioned in the opening paragraph, also referred to as a vapor pressure-controlled lamp, is disclosed in U.S. Pat. No. 4,093,889. The known lamp has a comparatively low mercury-vapor pressure at room temperature. As a result, the known lamp has the disadvantage that also the initial radiation output is comparatively low when a customary power supply is used to operate said lamp. In addition, the run-up time is comparatively long because the mercury-vapor pressure increases only slowly after switching on the lamp.

Apart from the above-described amalgam lamps, low-pressure mercury-vapor discharge lamps are known which comprise both a (main) amalgam and a so-called auxiliary amalgam. If the auxiliary amalgam comprises sufficient mercury, then the lamp has a relatively short run-up time. Immediately after the lamp has been switched on, i.e. during preheating the electrodes, the auxiliary amalgam is heated by the electrode so that it relatively rapidly dispenses a substantial part of the mercury that it contains. In this respect, it is desirable that, prior to being switched on, the lamp has been idle for a sufficiently long time to allow the auxiliary amalgam to take up sufficient mercury. If the lamp has been idle for a comparatively short period of time, the reduction of the run-up time is only small. In addition, in that case the initial radiation output is (even) lower than that of a lamp comprising only a main amalgam, which can be attributed to the fact that a comparatively low mercury-vapor pressure is adjusted in the discharge space by the auxiliary amalgam. An additional problem encountered with comparatively long lamps is that it takes comparatively much time for the mercury liberated by the auxiliary amalgam to spread throughout the discharge vessel, so that after switching on such lamps, they demonstrate a comparatively bright zone near the auxiliary amalgam and a comparatively dark zone at a greater distance from the auxiliary amalgam, which zones disappear after a few minutes.

Furthermore, low-pressure mercury-vapor discharge lamps are known which are not provided with an amalgam and contain only free mercury. These lamps, also referred to as mercury lamps, have the advantage that the mercury-vapor pressure at room temperature and hence the initial radiation output are comparatively high. In addition, the run-up time is comparatively short. After having been switched on, comparatively long lamps of this type also demonstrate a substantially constant brightness over substantially the whole length, which can be attributed to the fact that the vapor pressure (at room temperature) is sufficiently high at the time of switching on these lamps. Nominal operation at comparatively high lamp temperatures can be achieved using a mercury lamp whose discharge space contains (just) enough mercury to bring about a mercury-vapor pressure at the operating temperature which is close to the optimum mercury-vapor pressure. During the service life of the lamp, however, mercury is lost because it is bound, for example, to a wall of the discharge vessel and/or to emitter material. As a result, in practice such a lamp only has a limited service life. Therefore, the mercury dose in mercury lamps is substantially higher, in practice, than the quantity of mercury necessary during nominal operation in the vapor phase. However, this has the disadvantage that the mercury-vapor pressure is equal to the saturation vapor pressure pertaining to the temperature of the coldest spot of the discharge vessel. As the saturation vapor pressure increases exponentially with temperature, temperature variations, occurring for example in a badly ventilated luminaire or when the lamp is subjected to a high load, lead to a reduction of the radiation output. At comparatively low ambient temperatures, the mercury-vapor pressure decreases, which also leads to a reduction of the radiation output.

SUMMARY OF THE INVENTION

It is an object of the invention to provide a lamp of the type described in the opening paragraph, which, when it is used regularly, has a comparatively high initial radiation output and a comparatively short run-up time as well as a comparatively high radiation output in a comparatively large ambient-temperature range.

This object is achieved in accordance with the invention in that the amalgam comprises a bismuth-lead compound having a lead content (Pb) in the range between $35 \leqq Pb \leqq 60$ at. %, a bismuth content (Bi) in the range between $40 \leqq Bi \leqq 65$ at. %, and a mercury content (Hg) in the range between $0.05 \leqq Hg \leqq 1$ at. %.

The advantage of using such a Bi—Pb amalgam is that, at room temperature, the mercury-vapor pressure is comparatively close to that of liquid mercury. If the amalgam has the above-mentioned composition, the discharge lamp is nominally operated at a corresponding coldest spot temperature of the discharge vessel which lies in a comparatively wide temperature range from 65 to 165° C. A further advantage of the use of such a Bi—Pb amalgam resides in that the curves, in which the mercury-vapor pressure is plotted as a function of the temperature, can be adjusted via the mercury content. Said properties of the (main) amalgam, i.e. the wide temperature interval and the variable mercury-vapor pressure curves, are obtained by the choice of the composition of the Bi—Pb amalgam in accordance with the invention.

A further advantage of the use of a Bi—Pb amalgam in accordance with the invention resides in that the amalgam can be used in low-pressure mercury-vapor discharge lamps which can be dimmed.

Preferably, the lead content in the amalgam lies in the range between $40 \leqq Pb \leqq 50$ at. %, and the bismuth content lies in the range between $50 \leqq Bi \leqq 60$ at. %. Particularly suitable are compositions of the amalgam near the Bi—Pb eutectic point at 44 at. % Pb.

The above-mentioned composition of the Bi—Pb amalgam enables, in operation, at least 80% of the radiation output (nominal operation) of the low-pressure mercury-vapor discharge lamp to be achieved at a corresponding temperature of the coldest spot of the discharge vessel which lies in a relatively wide temperature range from 65 to 165° C. The run-up time of the discharge lamp comprising a Bi—Pb amalgam in accordance with the invention is less than ten minutes, in either case, while an auxiliary amalgam reduces the run-up time to less than 3 minutes. Amalgams of a composition in accordance with the invention are particularly suitable for use in (energy-saving) (compact) low-pressure mercury-vapor discharge lamps. Such discharge lamps have a good initial radiation output and combine a comparatively short run-up time with, at nominal operation, a comparatively wide interval for the temperature of the coldest spot of the discharge vessel. As a result, nominal lamp operation is possible in a comparatively large temperature interval.

Preferably, the mercury content (Hg) lies in the range between 0.05 and 0.75 at. % Hg.

A preferred embodiment of the low-pressure mercury-vapor discharge lamp in accordance with the invention is characterized in that the amalgam further comprises gold, the gold content (Au) lying in the range between $0.1 \leqq Au \leqq 20$ at. %.

Using the above-mentioned composition of the Bi—Pb—Au amalgam, in operation, at least 80% of the radiation output (nominal operation) of the low-pressure mercury-vapor discharge lamp is achieved at a corresponding temperature of the coldest spot of the discharge vessel which lies in a relatively wide temperature range from 50 to 160° C., while at least 90% of the radiation output is achieved at a corresponding temperature of the coldest spot which lies in a relatively wide temperature range from 70 to 130° C.

An additional advantage of the use of such a Bi—Pb—Au amalgam is that the curves, in which the mercury-vapor pressure is plotted as a function of the temperature, cannot only be adjusted via the mercury content but also via the composition of the amalgam.

The compositions of said Bi—Pb—Au amalgams in accordance with the invention are chosen to be such that the amalgam melts in a temperature range from 100 to 140° C. In addition, the small mercury content of said amalgams brings about a comparatively low mercury activity at higher temperatures (140–175° C.), the amalgam being present in the liquid state in the discharge vessel (the mercury is in the vapor phase). A comparatively high mercury activity at comparatively low temperatures is obtained in that the mercury does not readily mix with the underlying alloys. Bi—Pb—Au amalgam compositions are particularly suitable, in which the gold is added close to the above-mentioned eutectic point of Bi and Pb. Such amalgams have a Bi:Pb ratio of 56:44.

Preferably, the gold content in the amalgam lies in the range between $8 \leqq Au \leqq 12$ at. %. Bi—Pb—Au amalgams of such a composition exhibit a double peak in the mercury-vapor-pressure curves, which is caused by the melting of a large quantity of the ternary intermetallic compound of the structural formula $BiPb_3Au$ above the Bi—Pb eutectic point (at 125° C.).

A further advantage of the addition of gold to Bi—Pb amalgams is that, at low temperatures (room temperature), the mercury-vapor pressure is substantially independent of the mercury concentration up to very low mercury concentrations (0.3% Hg). As a result, the discharge lamp is comparatively insensitive to (irreversible) mercury loss in other lamp components, for example at the wall of the discharge vessel and/or at emitter material.

Apart from the above-mentioned materials, the amalgam in accordance with the invention may comprise additions of, for example, zinc, silver, gallium, indium, tin, antimony and/or other elements. It is desirable that such additions do not move the melting temperature range (100–140° C.) of the Bi—Pb alloys by more than 20° C.

At the start of the service life of a low-pressure mercury-vapor discharge lamp, comparatively much mercury can be bound at the wall during operation. To preclude this, the discharge vessel of a lamp in accordance with the invention may be coated with a metal-oxide protective layer at an inner surface. Such a protective layer, for example of scandium oxide, yttrium oxide, lanthanum oxide or an oxide of one of the lanthanide's, counteracts the loss of mercury caused by binding at the wall. A discharge lamp with a small mercury consumption is favorable since it enables a more optimum design of the amalgam.

These and other aspects of the invention will be apparent from and elucidated with reference to the embodiment(s) described hereinafter.

BRIEF DESCRIPTION OF THE DRAWINGS

In the drawings.

The Figures are purely diagrammatic and not drawn to scale. Particularly for clarity, some dimensions are exaggerated strongly. In the Figures, like reference numerals refer to like parts whenever possible.

DETAILED DESCRIPTION OF PREFERRED EMBODIMENTS

Figure 1A:
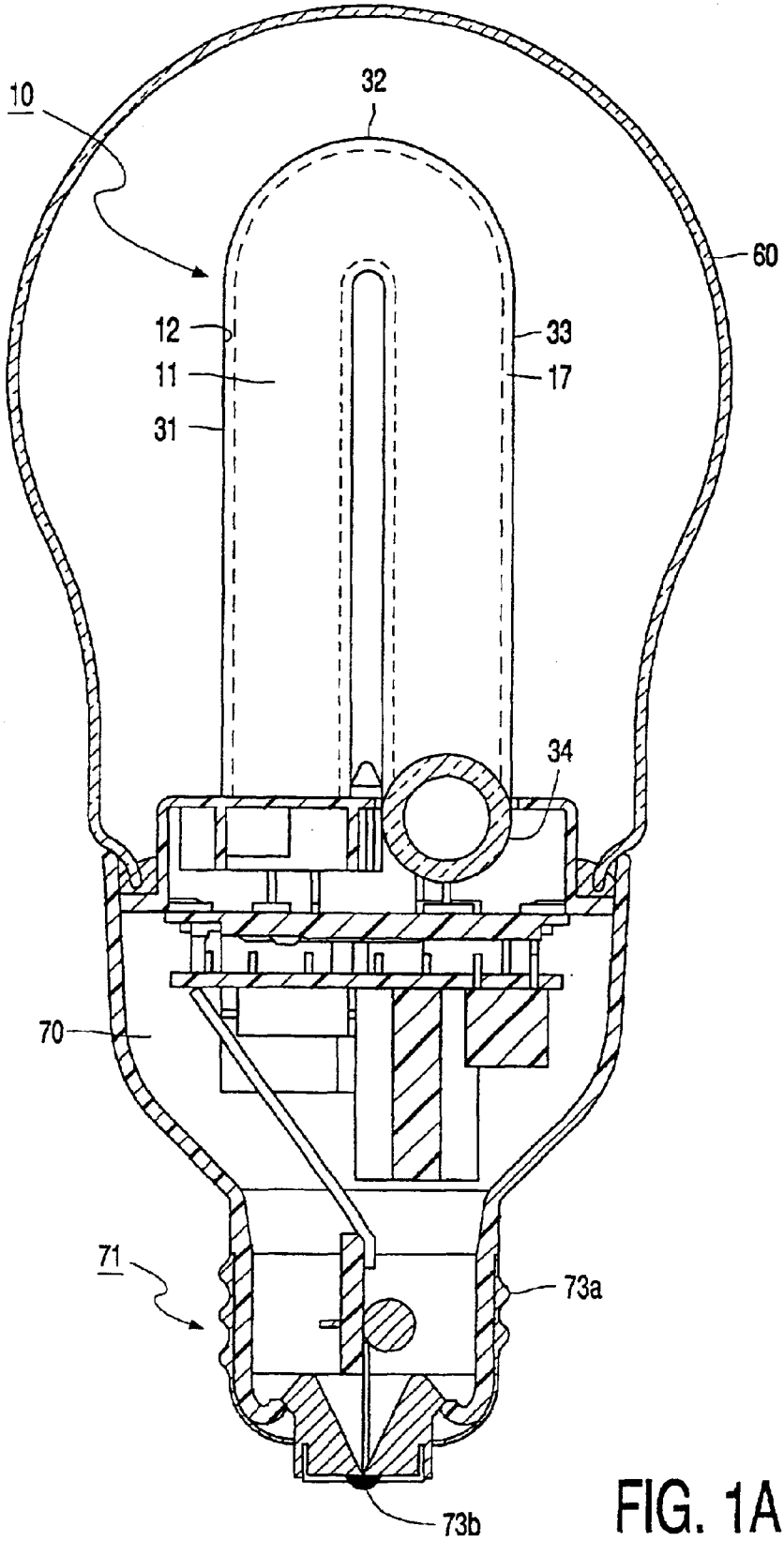
FIG. 1A is a cross-sectional view of an embodiment of a compact fluorescent lamp comprising a low-pressure mercury-vapor discharge lamp in accordance with the invention.

FIG. 1A shows a compact fluorescent lamp comprising a low-pressure mercury-vapor discharge lamp. Said low-pressure mercury-vapor discharge lamp is provided with a radiation-transmitting discharge vessel 10 which encloses a discharge space 11 having a volume of approximately 10 $cm^3$ in a gastight manner. The discharge vessel 10 is a glass tube which is at least substantially circular in cross-section and which has an (effective) inner diameter of approximately 10 mm. The tube is bent into the shape of a so-called hook and, in this example, includes a number of straight parts, two parts of which, referenced 31, 33 are shown in FIG. 1A. The tube further comprises a number of arc-shaped parts, two of which, referenced 32, 34, are shown in FIG. 1A. The discharge vessel 10 is provided with a luminescent layer 17 at an inner wall 12. In an alternative embodiment, the luminescent layer is omitted. The discharge vessel 10 is supported by a housing 70 which also supports a lamp cap 71 provided with electrical and mechanical contacts 73*a*, 73*b*, which are known per se. The discharge vessel 10 of the low-pressure mercury-vapor discharge lamp is surrounded by a light-transmitting envelope 60, which is secured to the lamp housing 70. The light-transmitting envelope 60 generally has a matt appearance.

Figure 1B:
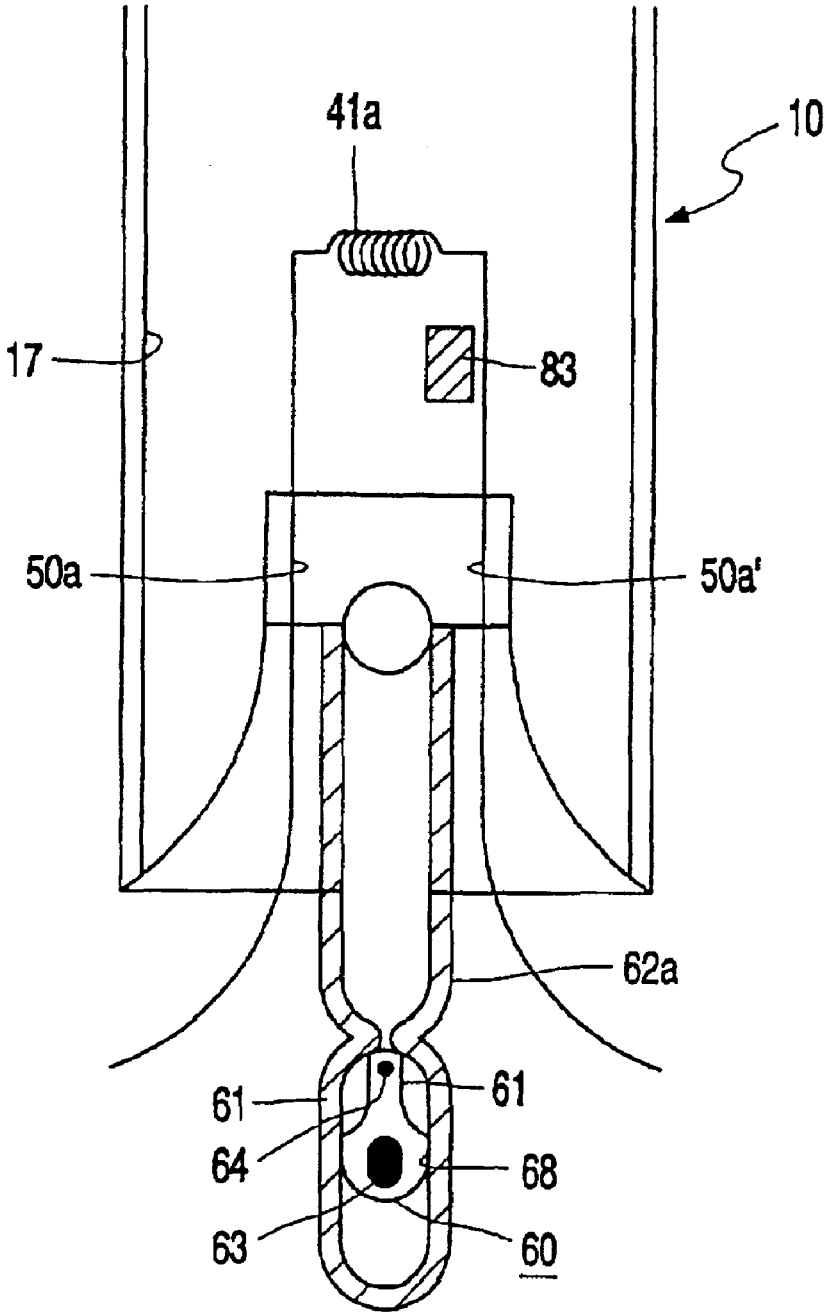
FIG. 1B is a cross-sectional view of a detail of the low-pressure mercury-vapor discharge lamp shown in FIG. 1A.

FIG. 1B is a very diagrammatic, cross-sectional view of a detail of the low-pressure mercury-vapor discharge lamp shown in FIG. 1A. Apart from mercury, the discharge space 11 in the discharge vessel 10 comprises an inert gas, in this example argon. Means for maintaining a discharge are formed by an electrode pair 41*a* (only one electrode is shown in FIG. 1B), which are arranged in the discharge space 11. The electrode pair 41*a* is a winding of tungsten covered with an electron-emitting substance, in this case a mixture of barium oxide, calcium oxide and strontium oxide. Each of the electrodes 41*a* is supported by a (narrowed) end portion of the discharge vessel 10. Current supply conductors 50*a*, 50*a*' extend from the electrode pair 41*a* through the end portions of the discharge vessel 10 where they issue to the exterior. The current supply conductors 50*a*, 50*a*' are connected to an (electronic) power supply, which is accommodated in the housing 70 and which is electrically connected to the electrical contacts 73*b* at the lamp cap 71 (see FIG. 1A).

In addition to mercury, the discharge space 11 comprises an inert gas, in this example argon and neon. In this example, mercury is not only present in the discharge space 11 but also in an amalgam 63 in accordance with the invention. For this purpose, in the example shown in FIG. 1B, a capsule 60 having a wall 61 of a lime glass containing 4.0% by weight FeO is arranged in the discharge vessel 10, in this case in a tubular bulge 62*a* thereof. In operation, the amalgam 63 communicates with the discharge vessel 10. In the wall 61 of the capsule 60, an opening 64 is formed by melting. The capsule 60 has a bulged-out portion 68 with which it is clamped in the bulge 62*a*. The capsule 60 comprises an amalgam 63 in accordance with the invention; in the embodiment shown a quantity of 100 mg of an amalgam of Hg with an alloy of bismuth, lead and gold. (Apart from small additions or impurities), a particularly suitable composition of the Bi—Pb—Au amalgam 63 in accordance with the invention has a lead content in the range from $40 \leqq Pb \leqq 50$ at. %, a bismuth content in the range from $50 \leqq Bi \leqq 60$ at. %, a gold content in the range from $8 \leqq Au \leqq 12$ at. % and a mercury content of approximately 0.5 at. % Hg.

In the example shown in FIG. 1B, one of the current supply conductors 50*a*' is further provided with a so-called flag carrying a so-called auxiliary amalgam 83. When the low-pressure mercury-vapor discharge lamp is switched on, the auxiliary amalgam 83 is heated by the electrode 41*a*, causing it to relatively rapidly release a substantial part of the mercury present therein. In an alternative embodiment of the above-described low-pressure mercury vapor discharge lamp, the amalgam is dosed without a capsule, in which case a glass rod is used to preclude the amalgam from entering the discharge vessel.

Bi—Pb and Bi—Pb—Au amalgams in accordance with the invention can particularly suitably be used in (compact) fluorescent lamps.

An alternative embodiment of the discharge lamp in accordance with the invention comprises the so-called electrodeless discharge lamps, in which the means for maintaining an electric discharge are situated outside a discharge space surrounded by the discharge vessel. Generally said means are formed by a coil provided with a winding of an electric conductor, with a high-frequency voltage, for example having a frequency of approximately 3 MHz, being supplied to said coil, in operation. In general, said coil surrounds a core of a soft-magnetic material.

Figure 2:
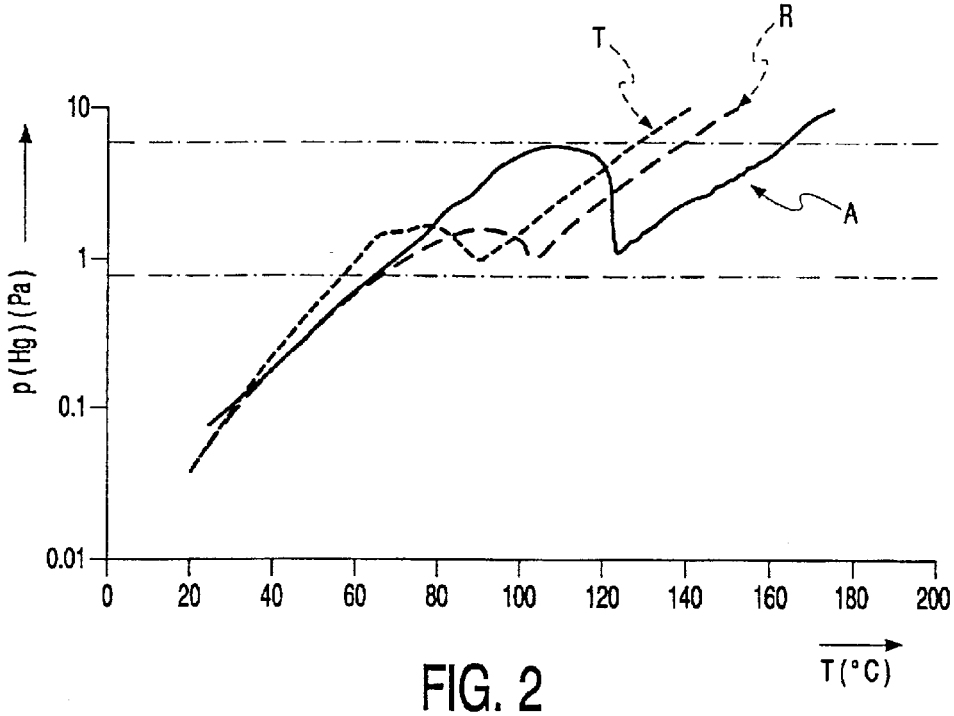
FIG. 2 is a graph comparing the mercury-vapor pressure as a function of the temperature for a Bi—Pb amalgam in accordance with the invention with mercury-vapor pressure curves of two known amalgams.

FIG. 2 shows a graph wherein the mercury-vapor pressure (pHg expressed in Pa) as a function of the temperature (in degrees Celsius) of a particularly suitable amalgam Bi56-Pb44-Hg0.5 (curve A) in accordance with the invention is compared with corresponding mercury-vapor pressure curves of two well-known amalgams, namely Bi53-Sn47-Hg3 (curve R, amalgam known from U.S. Pat. No. 4,157,485) and Bi48-Sn24-Pb28-Hg3 (curve T, amalgam known from U.S. Pat. No. 4,093,889). The two horizontal chain-dotted lines show the range within which the radiation output is at least 80% of that during optimum operation. A comparison between the mercury-vapor pressure curves shown in FIG. 2 shows that the Bi—Pb amalgam in accordance with the invention has a wider stabilization range and that such amalgams can be applied in lamps having a higher coldest spot temperature.

Figure 3:
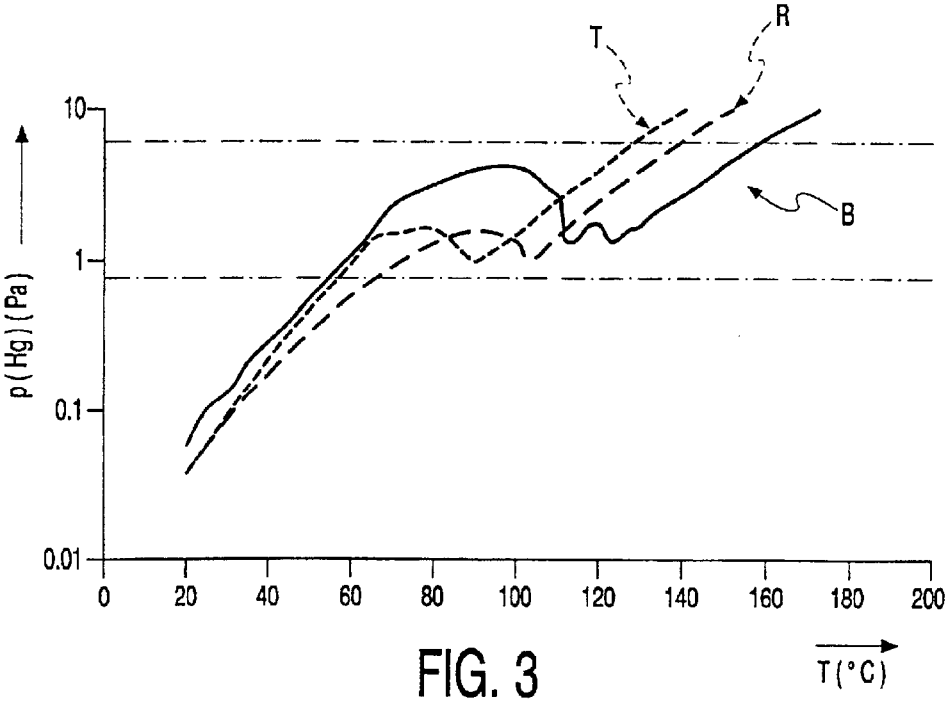
FIG. 3 is a graph comparing the mercury-vapor pressure as a function of the temperature for a Bi—Pb—Au amalgam in accordance with the invention with mercury-vapor pressure curves of two known amalgams.

FIG. 3 shows a graph wherein the mercury-vapor pressure ($p_{Hg}$ expressed in Pa) as a function of the temperature (in degrees Celsius) of a particularly suitable amalgam Bi50-Pb40-Au10-Hg0.5 (curve B) in accordance with the invention is compared with corresponding mercury-vapor pressure curves of two well-known amalgams, namely Bi53-Sn47-Hg3 (curve R, amalgam known from U.S. Pat. No. 4,157,485) and Bi48-Sn24-Pb28-Hg3 (curve T, amalgam known from U.S. Pat. No. 4,093,889). The two horizontal chain-dotted lines show the range within which the radiation output is at least 80% of that during optimum operation. The mercury-vapor pressure curve for the Bi50-Pb40-Au10-Hg0.5 amalgam exhibits a double peak as a result of the melting of a large quantity of the ternary, intermetallic compound of structural formula $BiPb_3Au$ above the Bi—Pb eutectic point at 125° C. A comparison between the mercury-vapor pressure curves shown in FIG. 3 shows that the Bi—Pb—Au amalgam in accordance with the invention has a wider stabilization range and that such amalgams can be applied in lamps having a higher coldest spot temperature.

For electrodeless low-pressure mercury-vapor discharge lamps, which consume relatively little mercury during their service life, a more optimum amalgam can be designed having a relatively low initial mercury content, which is favorable for obtaining a high radiation output in a relatively large ambient temperature range during the service life of the discharge lamp.

It will be clear that, within the scope of the invention, many variations are possible to those skilled in the art. The scope of protection of the invention is not limited to the examples given hereinabove. The invention is embodied in each novel characteristic and each combination of characteristics. Reference numerals in the claims do not limit the scope of protection thereof. The use of the verb "to comprise" and its conjugations does not exclude the presence of elements or steps other than those mentioned in the claims. The use of the article "a" or "an" in front of an element does not exclude the presence of a plurality of such elements.

What is claimed is:

1. A low-pressure mercury-vapor discharge lamp comprising a discharge vessel, the discharge vessel enclosing a discharge space provided with a filling of mercury and an inert gas in a gastight manner, the discharge vessel containing an amalgam which communicates with the discharge space, and the low-pressure mercury-vapor discharge lamp comprising discharge means for maintaining an electric discharge in the discharge space, the amalgam comprising a bismuth-lead compound having a lead content (Pb) in the range between $35 \leqq Pb \leqq 60$ at. %, a bismuth content (Bi) in the range between $40 \leqq Bi \leqq 65$ at. %, and a mercury content (Hg) in the range between $0.05 \leqq Hg \leqq 0.75$ at. %, the amalgam further comprising gold, the gold content (Au) lying in the range between $0.1 \leqq Au \leqq 20$ at. %.

2. A low-pressure mercury-vapor discharge lamp as claimed in claim 1, wherein the gold content lies in the range between $8 \leqq Au \leqq 12$ at. %.

3. An amalgam for use in a low-pressure mercury-vapor discharge lamp as claimed in claim 1.

4. A low-pressure mercury-vapor discharge lamp comprising a discharge vessel, the discharge vessel enclosing a discharge space provided with a filling of mercury and an inert gas in a gastight manner, the discharge vessel containing an amalgam which communicates with the discharge space, the low-pressure mercury-vapor discharge lamp comprising discharge means for maintaining an electric discharge in the discharge space, the amalgam comprising a bismuth-lead compound having a lead content (Pb) in the range between $35 \leqq Pb \leqq 60$ at. %, a bismuth content (Bi) in the range between $40 \leqq Bi \leqq 65$ at. %, and a mercury content (Hg) in the range between $0.05 \leqq Hg \leqq 1$ at. %, and a temperature of the coldest spot of the discharge vessel during operation of the lamp being in the range between 65° C. and 165° C.

5. The low-pressure mercury-vapor discharge lamp of claim 4 wherein the temperature of the coldest spot of the discharge vessel during operation of the lamp is in the range between 120° C. and 165° C.

6. The low-pressure mercury-vapor discharge lamp of claim 4 wherein the amalgam has a mercury content (Hg) in the range between $0.05 \leqq Hg \leqq 0.75$ at. %.

7. A low-pressure mercury-vapor discharge lamp comprising a discharge vessel, the discharge vessel enclosing a discharge space provided with a filling of mercury and an inert gas in a gastight manner, the discharge vessel containing an amalgam which communicates with the discharge space, the low-pressure mercury-vapor discharge lamp comprising discharge means for maintaining an electric discharge in the discharge space, the amalgam comprising a bismuth-lead compound having a lead content (Pb) in the range between $35 \leqq Pb \leqq 60$ at. %, a bismuth content (Bi) in the range between $40 \leqq Bi \leqq 65$ at. %, and a mercury content (Hg) in the range between $0.05 \leqq Hg \leqq 0.75$ at. %, and the range of nominal operation of the lamp including operation with an amalgam temperature between 120° C. and 165° C.

8. A low-pressure mercury-vapor discharge lamp comprising a discharge vessel, the discharge vessel enclosing a discharge space provided with a filling of mercury and an inert gas in a gastight manner, the discharge vessel containing an amalgam which communicates with the discharge space, the low-pressure mercury-vapor discharge lamp comprising discharge means for maintaining an electric discharge in the discharge space, the amalgam comprising a bismuth-lead compound having a lead content (Pb) in the range between $35 \leqq Pb \leqq 60$ at. %, a bismuth content (Bi) in the range between $40 \leqq Bi \leqq 65$ at. %, and a mercury content (Hg) in the range between $0.05 \leqq Hg \leqq 1$ at. %, and the lamp having a radiation output at an optimal mercury vapor pressure and being configured to operate at at least 80% of said radiation output over a range of amalgam temperatures between 65° C. and 165° C.

* * * * *